US007614826B2

(12) United States Patent
Vriens

(10) Patent No.: US 7,614,826 B2
(45) Date of Patent: Nov. 10, 2009

(54) METHOD AND DEVICE FOR WATERPROOFING AND DRAINING OFF INFILTRATED WATER IN HYDRAULIC STRUCTURES

(75) Inventor: Wilhelmus Josephus Maria Vriens, Bergen Op Zoom (NL)

(73) Assignee: GSI B.V., Berkel en Rodenrijs (NL)

( * ) Notice: Subject to any disclaimer, the term of this patent is extended or adjusted under 35 U.S.C. 154(b) by 0 days.

(21) Appl. No.: 12/094,606

(22) PCT Filed: Nov. 22, 2006

(86) PCT No.: PCT/EP2006/011163

§ 371 (c)(1),
(2), (4) Date: May 22, 2008

(87) PCT Pub. No.: WO2007/059924

PCT Pub. Date: May 31, 2007

(65) Prior Publication Data

US 2008/0298896 A1 Dec. 4, 2008

(30) Foreign Application Priority Data

Nov. 23, 2005 (EP) ..... 05025533

(51) Int. Cl.
*E02B 7/04* (2006.01)

(52) U.S. Cl. ..... 405/107; 405/109

(58) Field of Classification Search ..... 405/107–115
See application file for complete search history.

(56) References Cited

U.S. PATENT DOCUMENTS

| | | | | | |
|---|---|---|---|---|---|
| 1,802,714 | A | * | 4/1931 | Skelton | 405/107 |
| 3,854,292 | A | | 12/1974 | Nienstadt | |
| 4,371,288 | A | | 2/1983 | Borca et al. | |
| 4,913,583 | A | | 4/1990 | Ledeuil | |
| 4,915,542 | A | | 4/1990 | Fernando | |
| 5,143,480 | A | * | 9/1992 | Scuero | 405/107 |
| 5,720,576 | A | | 2/1998 | Scuero | |
| 5,806,252 | A | | 9/1998 | Scuero | |

FOREIGN PATENT DOCUMENTS

| | | | |
|---|---|---|---|
| DE | 27 34 514 | | 2/1979 |
| DE | 101 27 493 | A1 | 12/2002 |
| EP | 0 459 015 | A1 | 12/1991 |
| EP | 0 722 016 | A1 | 7/1996 |
| JP | 2003-55935 | A | 2/2003 |
| WO | 00/34588 | | 6/2000 |

* cited by examiner

*Primary Examiner*—Frederick L Lagman
(74) *Attorney, Agent, or Firm*—Young & Thompson

(57) ABSTRACT

A sheathing of elastically deformable waterproofing sheet material (11) is applied and sealingly secured to a surface area of a hydraulic structure (10; 31; 36, 39) to be protected. The seeped water, which collects behind the waterproof sheathing (11), is discharged by gravity through one-way drainage valves (13), provided in pre-established drainage positions of the waterproof sheathing (11); the drainage valves (13) are automatically opened and closed by the differential pressure of the water acting on opposite faces of a flexible sheet like flat valving member (M) of the drainage valve (13).

22 Claims, 6 Drawing Sheets

METHOD AND DEVICE FOR WATERPROOFING AND DRAINING OFF INFILTRATED WATER IN HYDRAULIC STRUCTURES

FIELD OF THE INVENTION

This invention refers to the formation of protective and waterproof sheathings on surfaces of hydraulic structures, by means of which it is possible to drain off the seeped water that collects between the surface of the hydraulic structure and the protective sheathing, by means of an appropriate valve system provided in the waterproof sheathing itself.

The invention in particular relates to the formation of waterproof sheathings provided with automatic drainage of the seeped water, for any type of hydraulic structure, such as earth or concrete dams, such as RCC (roller compacted concrete) dams, hydraulic tunnels, reservoirs and canals, or for any other type of hydraulic structure for which a sheathing and a water drainage system is required.

Waterproofing devices are known and widely used for protecting the surfaces of hydraulic structures intended to come into contact with water, in order to prevent excessive, and in certain cases dangerous, leakage of water through the main body of the hydraulic structure itself.

A known waterproofing device substantially consists in applying a waterproof sheathing onto the surface of the hydraulic structure to be protected, comprising for example a geomembrane of elastomeric and/or thermoplastic material, such as PVC or other elastically deformable synthetic material, and providing a suitable mechanical anchoring system for fastening the geomembrane to a surface area of the hydraulic structure to be protected; a geonet, a geotextile, a draining spacer or "geospacer", or a layer of highly permeable loose material, for example gravel or sand, with a permeability coefficient of $K<10^{-7}$ m/s, may be disposed between the waterproofing geomembrane and the surface area of the hydraulic structure to protect the latter or to form a hollow space for collection of the seeped water which must be continuously discharged towards the outside, by means of a suitable system of drainage channels or conduits.

Devices for the protection of hydraulic structures by waterproof geomembranes can be found in several prior documents, for example in U.S. Pat. No. 4,913,513 and U.S. Pat. No. 5,720,576, insofar as the waterproofing of dams is concerned; in U.S. Pat. No. 4,371,288 and U.S. Pat. No. 4,915,542, insofar as the waterproofing of tunnels and hydraulic tunnels is concerned; in U.S. Pat. No. 5,806,252 and U.S. Pat. No. 3,854,292, for canals and the like; as well as in DE-A-2 734 514 and EP-A-1 157 168, insofar as the waterproofing of joints or cracks.

In all these applications there is a common need to provide a suitable drainage device for draining off or discharging the water seeped through the body of the hydraulic structure, which collects between the same body and the waterproof sheathing.

The absence of any device for draining off the seeped water, in hydraulic structures provided with a waterproof sheathing of elastically deformable synthetic material, would give rise to serious problems, due to the fact that the water which collects behind the sheathing, would cause the same sheathing to swell and form dangerous water pockets, with the severe risk of damaging and/or tearing the protective sheathing in correspondence with the anchorage points or the areas subjected to high stresses.

In order to partially obviate this problem, some solutions have been proposed; for example, U.S. Pat. No. 4,913,583, suggests to embed into the body of the dam, during its construction, a waterproofing membrane and a system of microperforated pipes for discharging the drained off water on the rear side of the sheathing.

Conversely, U.S. Pat. No. 5,720,576 makes use of the same structural sections used for anchoring the waterproofing membrane to the upstream surface of the dam, to flow the seeped water to the bottom of the structure, by providing a longitudinal manifold which subsequently discharges the water downstream or to the outside in given points of the hydraulic structure.

Although these solutions have provided satisfactory results, the construction of a drainage device is not always possible in a previously existing structure, or proves to be extremely difficult and expensive.

Consequently, whenever the hydrostatic level of the water on the upstream side, or inside the hydraulic structure, tends to decrease, in the absence of any discharging system, the pressure of the water, behind or on the rear side of the waterproof sheathing or membrane, under certain conditions could cause it to burst or become torn in the areas subjected to the greatest stress.

In order to maintain the efficiency of the drainage device it is therefore necessary to periodically carry out complicated and costly maintenance operations; moreover, in certain cases, for example in existing earth dams and hydraulic tunnels, or in certain canals, the construction and/or maintenance of a drainage system is, in fact, made impossible.

In an attempt to remedy to problems arising from previously known drainage devices, JP-A-2003055935 suggests the use of a check valve on the bottom of a waterway, allowing only inflow from the outside, nevertheless there is also the problem of maintaining the drainage system in efficient working condition, due to the fact that over time it tends to become clogged, preventing the water from flowing freely.

OBJECTS OF THE INVENTION

The main object of this invention is to provide a method for waterproofing and draining off seeped water in hydraulic structures, such as dams, tunnels, canals and the like, by means of which it is possible to achieve an effective automatic drainage of the seeped water, both in existing hydraulic structures, and during their construction.

A still further object is to provide a method as mentioned previously, by means of which it is possible to achieve a drainage both during and after the waterproof sheathing has been installed, at any point of the hydraulic structure, wherever required.

A further object of the invention is to provide a waterproofing device for hydraulic structures, by means of which it is possible to exploit the differential pressure of the water on both fore and rear sides of the waterproof sheathing, to cause an automatic discharge of the seeped water, while at the same time preventing the water normally contained or flowing in the hydraulic structure, from seeping towards the outside or into the surrounding soil.

A still further object is to provide a drainage device which is structurally simple, highly efficient, does not require costly maintenance operations, and at the same time is simple and inexpensive.

Advantageously, the construction of a waterproof sheathing for membrane provided with a drainage device according to this invention can be carried out both in the presence and in the absence of water upstream or inside the hydraulic structure, also over an already installed waterproofing membrane.

BRIEF DESCRIPTION OF THE INVENTION

The above can be achieved by means of a method for waterproofing and draining off seeped water in hydraulic structures, according to claim 1, or by means of a sheathing and drainage device according to claim 18.

In particular, according to the invention, a method for waterproofing and draining off seeped water through the body of hydraulic structures, according to which a waterproof sheathing, consisting of elastically deformable geomembrane sheets, is applied and secured to a surface area of a wall of the body of the hydraulic structure, providing said sheathing with a one-way water drainage valve for draining off the seeped water collected behind the waterproof sheathing, comprising the steps of:

defining drainage points for draining off the water in pre-established positions of the waterproof sheathing;

providing, in each of the pre-established drainage point, a one-way drainage valve having a water discharging aperture in said waterproof sheathing;

orienting said water discharging aperture of the drainage valve in a natural downflow direction of the water and providing said drainage valve device with a flat flexible valving member, overlapping the discharging aperture;

subjecting the flat valving member to a differential pressure of the water acting on opposite faces of the waterproofing sheathing; and causing automatic opening and closing of the drainage valve, by the pressure difference of the water arising on the opposite faces of the flat valving member of the drainage valve, characterised by the steps of providing said drainage valve on a wall surface of the hydraulic structure; and downwardly draining the seepage water, by gravity.

According to a further aspect of the invention, a device has been provided for waterproofing and draining off seeped water through the body of hydraulic structures, comprising:

a waterproof sheathing, consisting by a geomembrane of elastically yieldable material;

fastening means to secure the geomembrane to a surface area of a wall of the hydraulic structure, and drainage means for draining off the seeped water collected between the surface area of the hydraulic structure and the waterproof sheathing, said drainage means comprising:

a plurality of one-way drainage valves on the waterproof geomembrane; each drainage valve comprising:

a water discharging aperture in the waterproof geomembrane, said water discharging aperture extending in a direction transversal to the natural downflowing direction of the seepage water; and a flexible flat valving member sealingly fastened to the waterproofing membrane, said flat valving member having a free edge which extends beyond said water discharging aperture, characterised in that the drainage valves are provided on a wall of the body of the hydraulic structure, said drainage valves being arranged to drainage the seepage water downwardly, by gravity.

According to several embodiments, the discharge valve device can extend over part or the entire width of opposite edges of sheet materials of the waterproof geomembrane.

The drainage valve device can be provided and carried out during the construction and installation of the waterproof geomembrane, for example by overlapping a certain length of the cross edges of two consecutive sheets of the sheathing, without sealing them; it is also possible to form the drainage valve device after the waterproof sheathing has been installed, for example by making a cut or an aperture for the outflow of the water in the waterproof sheathing, and subsequently covering the cut or aperture with a valving sheet of an elastically deformable synthetic or bituminous material, which is sealed on three consecutive edges more precisely the rear edge and two lateral edges of the cut or aperture; the fore edge of the valving sheet is consequently left free to flex and lift up and down under the effect of the differential pressure of the water acting on the fore and rear faces of the same valving sheet, to enable the outflow of the seeped water, preventing water inflow.

Other features of the method and the waterproofing and drainage device according to the invention are defined by the dependent claims.

BRIEF DESCRIPTION OF THE DRAWINGS

These and further features of the method and the drainage device according to this invention, and several of its possible embodiments, are illustrated hereunder with reference to the accompanying drawings, in which.

DETAILED DESCRIPTION OF THE INVENTION

With reference to the figures from 1 to 5 a description is given hereunder of the general features of the method and of the waterproofing and drainage system according to the invention.

Figure 1:
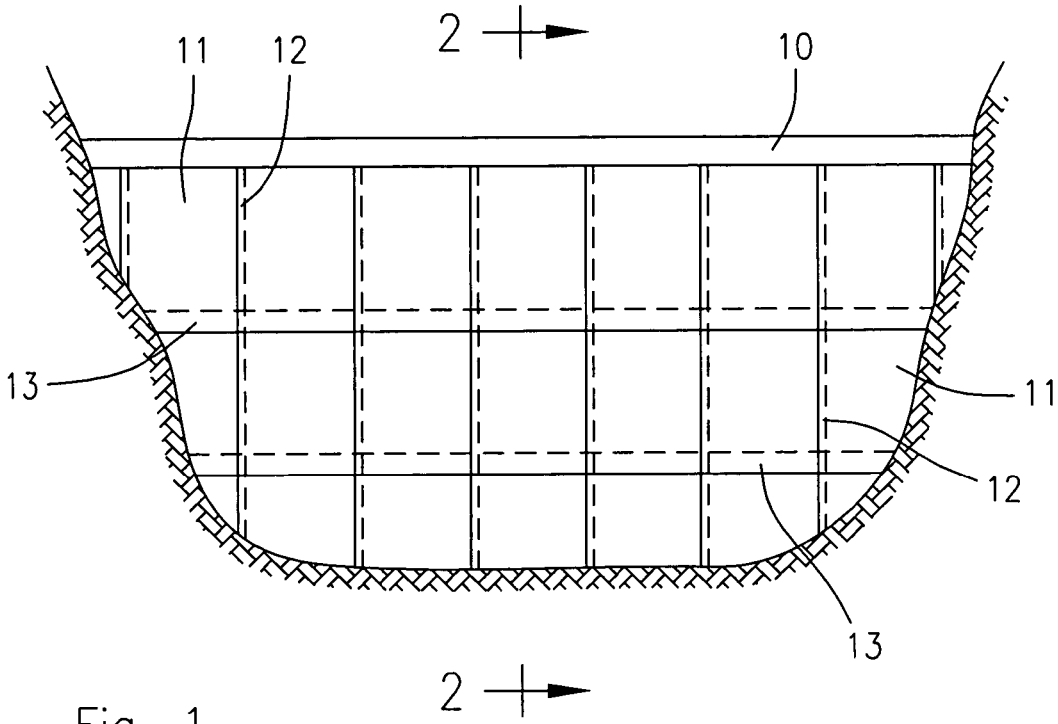
FIG. 1 schematically shows a front view of the upstream side of a dam provided with a waterproof sheathing comprising a drainage device according to the invention.

FIG. 1 shows a generic dam comprising a main body 10, for example made of roller and compacted concrete or of fill material, or other types of material, which extends between the slopes of two mountains. The main body 10 of the dam, on the upstream side into contact with the water contained in the basin, is provided with a waterproof sheathing comprising, for example, a plurality of sheets 11 of elastically deformable synthetic or bituminous material; the sheets 11 are applied to the surface of the dam 10 maintaining the side edges 12 partially overlapping, and then sealingly connected together, for example, thermally sealed, by ultrasonic method, chemically, or in any other suitable way, and mechanically secured to the main body 10 of the dam.

Figure 2:
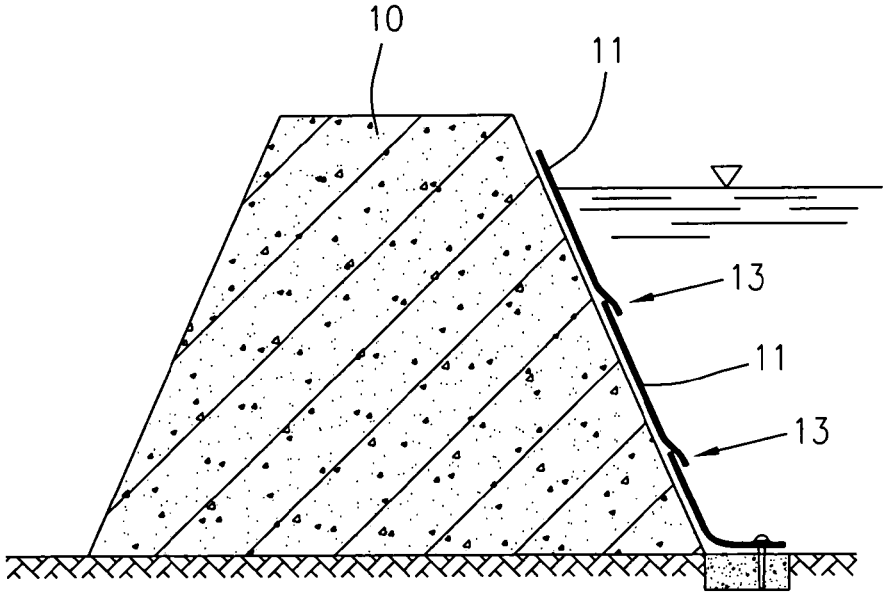
FIG. 2 shows a cross-sectional view along the line 2-2 of FIG. 1.

The sheets 11 can be secured by any known means, for example by providing suitable structural steel sections which enable them to be tensioned or stretched, as described for example in U.S. Pat. No. 5,720,576; or by means of a plurality of pins 14 (FIG. 3) as shown and described in U.S. Pat. No. 4,915,542, or in any other appropriate way. Reference 13 in FIGS. 1 and 2 has been used to indicate a one-way valve device for draining off the water which has seeped from the main body 10 of the dam between the front surface of the dam body and the rear side of the waterproof sheathing provided by the assembly of sheets 11.

Depending upon requirements or the type of hydraulic structure, the sheets 11 of synthetic material can be placed in direct contact with the surface to be waterproofed. Conversely, a layer 15 of draining material can be disposed between the sheets 11 and the front surface of the hydraulic structure, for example a geonet, a geospacer or the like, as shown in FIGS. 4 and 5.

The sheets 11 of waterproof material can in turn be in the form of a geocomposite, comprising a layer of waterproof material, coupled to a geotextile, in a per se known way, provided they are suitable for the intended use.

Figure 3:
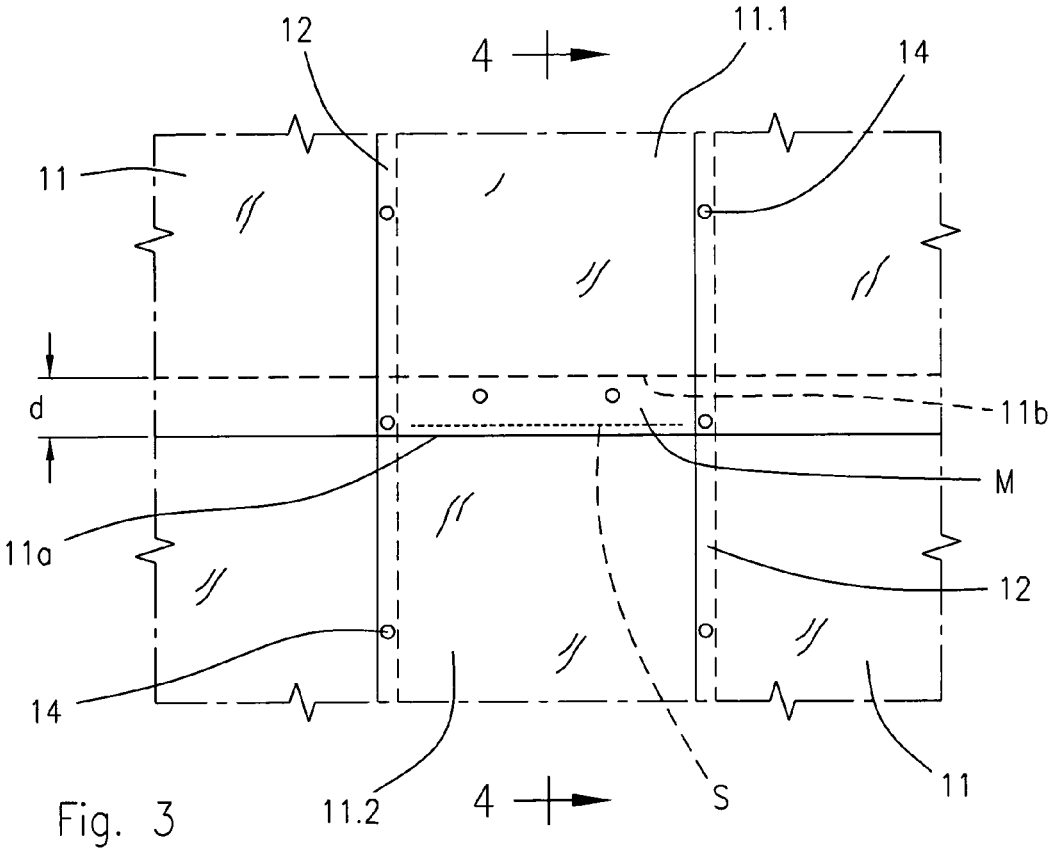
FIG. 3 shows an enlarged detail of FIG. 1, illustrating the detail of a one-way drainage valve device.
Figure 4:
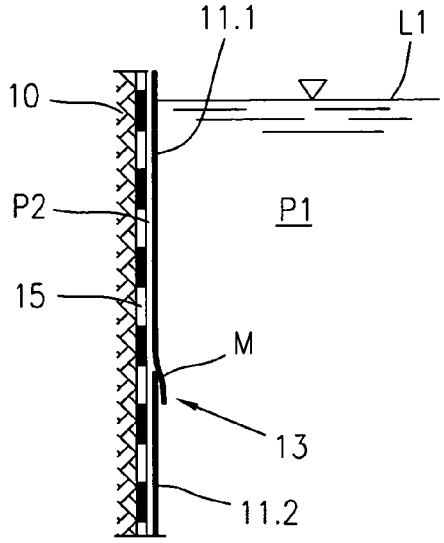
FIG. 4 shows a cross-section along the line 4-4 of FIG. 3, with the valve device in a closed condition.
Figure 5:
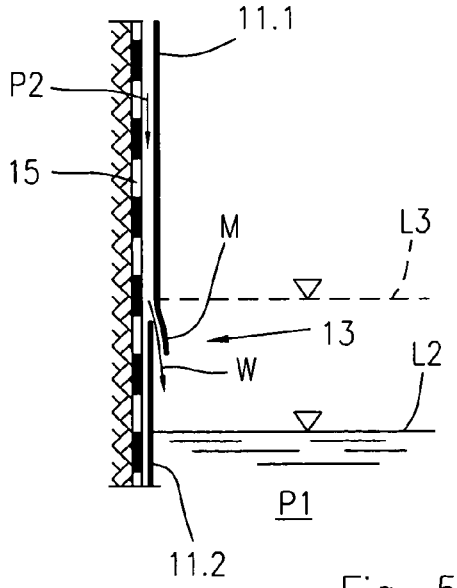
FIG. 5 shows a view similar to that of FIG. 4, with the valve device in an open condition.

A one-way drainage valve 13, in a waterproofing and draining device according to the invention, and its working are explained in greater detail hereunder, with reference to FIGS. 3, 4 and 5.

According to a preferential embodiment, the one-way drainage valve device 13 is obtained directly during the formation of the waterproof sheathing. In this configuration, during the installation of the waterproofing sheet material 11, as indicated in FIG. 3, attention is paid to ensure that the fore transversal edge 11*a* of one sheet 11.1 partially overlaps the rear transversal edge 11*b* of the adjacent sheet 11.2, for a space "d" of a pre-established length, for example ranging from 5 to 300 cm, preferably from 20 to 150 cm.

During the installation of the sheets 11.1 and 11.2, the overlapped side edges 12 of the juxtaposed sheets will be sealed together, and subsequently secured by means of pins 14, or in any other way.

During the sealing and fastening of the sheets 11, care must be taken to ensure that the overlapped transversal edge 11*a* of the overlying sheet 11.1 must be free, that is to say, the edge of the upper sheet 11.1, is free to flex, and/or move up and down with respect to the underlying sheet 11.2, and to extend beyond the transversal edge 11*b* of the latter in the direction of the natural downflow of the water, by gravity; in this way a one-way valve device is obtained directly by the waterproof sheathing, which is capable of being operated by the differential pressure of the water acting on a flexible flat valving member M, provided by a portion of the sheet 11.1 overlapping the sheet 11.2; the outflow aperture thus provided will be oriented in the natural downflow direction of the water which seeps, from the main body 10 of the hydraulic structure, between the latter and the waterproof sheathing, allowing a natural discharge of the water simply by gravity.

More precisely, the overlapped transversal edges 11*a* and 11*b* of the two sheets 11.1 and 11.2 which define a one-way drainage valve of the geomembrane type, in a drainage device according to this invention can extend along part or along the entire width of the sheets, as shown.

In general terms, the length "d" of the edges overlapped between two adjacent sheets, and the width of the geomembrane valve device 13 must be such as to enable the efficient operation of the valve thus formed. In particular, the surface freely in contact of the two superposed sheets which constitute the valve device 13, must be of such kind as to provide a seal exclusively by means of the pressure P1 of the water existing upstream or inside the hydraulic structure, as shown in FIG. 4, and to prevent the formation of folds along the edge 11*a* of the valve, for example by securing the sheets 11 with an appropriate tension. In this way a wide outflow aperture is obtained for the downflow of the water, in the open condition of the valve device shown in FIG. 5; this is also facilitated by the possible elastic deformation of the flat valving member M of the valve device 13, due to the pressure P2, exerted by the water to be drained off, on the rear side of the waterproof sheathing, when the aforesaid pressure P2 exceeds the pressure P1 on the front side.

FIGS. 4 and 5 of the drawing show the closed and open conditions of the valve device 13 under the effect of the differential pressure of the water, exerted on the two faces of the sheathing.

In particular, as can be seen in FIG. 4, as long as the level L1 of the water is above the valve device 13, that is to say, as long as the pressure P1 of the water on the front side of the flat valving member M of the valve device 13 directly in contact with the water exceeds the pressure P2 on the rear side, facing the surface of the hydraulic structure 10, a positive differential pressure P1-P2 will be exerted on the member M, which will maintain the member M constantly pressed against the edge of the underlying sheet 11.2; this closed valve condition is shown in FIG. 4.

Conversely, when the level of the water drops below the valve device 13, for example as indicated by reference L2 in FIG. 5, a negative differential pressure P1-P2 will be exerted, and consequently the pressure P2 of the water behind the waterproof sheathing 11 will tend to open the flat valving member M of the valve 13, moving away the valving member M of the upper sheet 11.1 from the edge 11*b* of the underlying sheet 11.2; in these conditions the seeped water can flow out through the opened drainage valve device 13; when the level L1 of the water is restored, the valve device 13 will be closed again by the pressure of the water on the front side.

The valve device 13 will operate in the same way, each time the differential pressure P1-P2 is negative, that is to say, each time the pressure P2 is higher than the hydrostatic pressure P1 existing at the level L3 of the valve 13, as schematically indicated in FIG. 5 of the accompanying drawings.

In this way it is possible to obtain a waterproof sheathing provided with water drainage device which uses flexible one way valves, automatically operated, both to open and to close, by the differential pressure of the water existing on the two sides of the waterproof sheathing itself.

A drainage device which uses a geomembrane-type single-acting water discharge valve according to the invention, in addition to being simple and inexpensive, is operatively extremely reliable over time, without requiring any substantial maintenance.

Although in principle the invention is applicable to any type of waterproof sheathing of elastically deformable synthetic or bituminous material, best results are obtained by using highly flexible plastic materials in sheets.

The material used for the geomembrane constituting the waterproof sheathing and/or the drainage valve device can be of any kind whatsoever, provided it is suitable for the intended purpose; in particular, it can be chosen from among synthetic and bituminous materials in the following table, taken either individually or in combination.

| TYPE | BASIC MATERIAL | ABBREVIATION |
|---|---|---|
| THERMOPLASTIC MATERIALS | High density polyethylene | HDPE |
| | Linear low density polyethylene | LLDPE |
| | Chlorinated polyethylene | CPE |
| | Ethylene-vinyl acetate coplymer | EVA/C |
| | Polyethylene | PE |
| | Polypropylene | PP |
| | Polyvinyl chloride | PVC |
| THERMOPLASTIC RUBBERS | Chlorosulphonate polyethylene | CSPE |
| | Ethylene-propylene copolymer | E/P |
| THERMOSET MATERIALS | Polyisobutylene | PIB |
| | Chloroprene rubber | CR |
| | Ethylene-propylene diene monomer | EPDM |
| | Butyl rubber | IIR |
| | Nitrile rubber | NBR |
| BITUMINOUS MATERIALS | Oxidised bitumen | Prefabricated GM |
| | Polymeric bitumen | — |

The geomembranes may be of a thickness ranging from 0.2 to 60 mm, with a modulus of elasticity ranging from 10 to 5,000 MPa.

Figure 6:
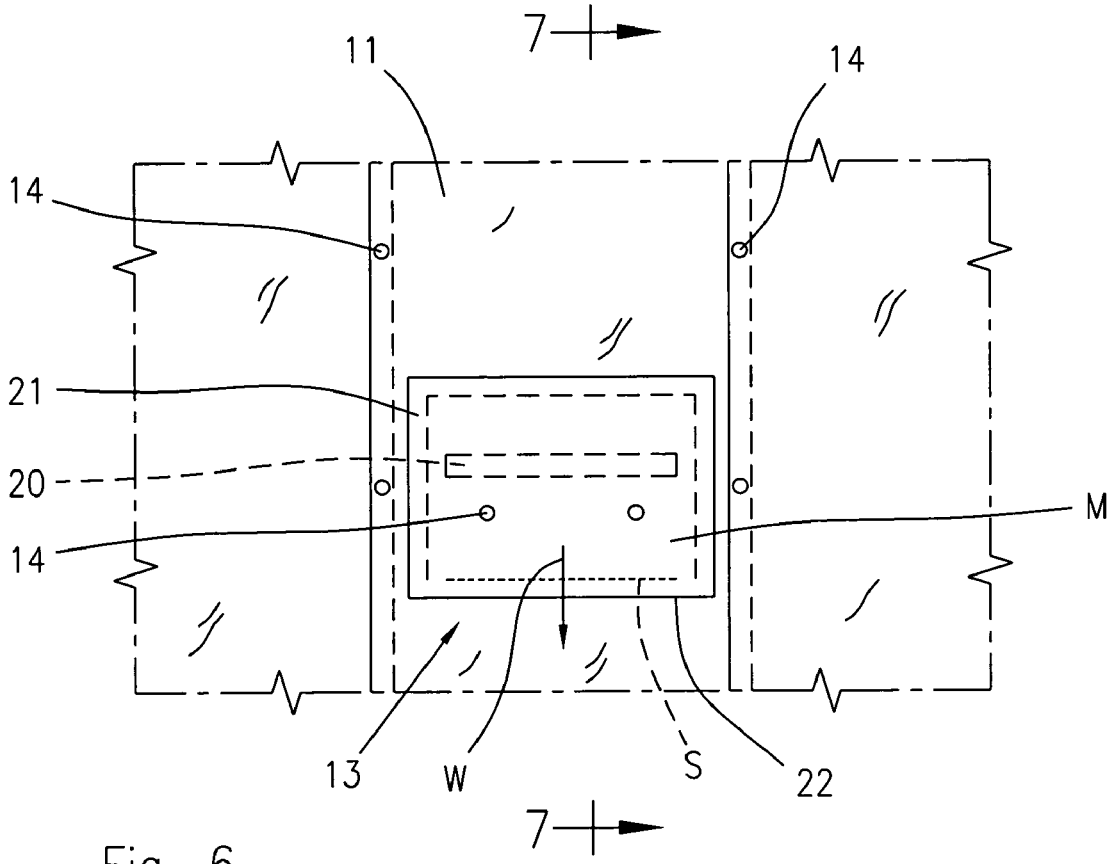
FIG. 6 shows a second embodiment of the drainage valve device.
Figure 7:
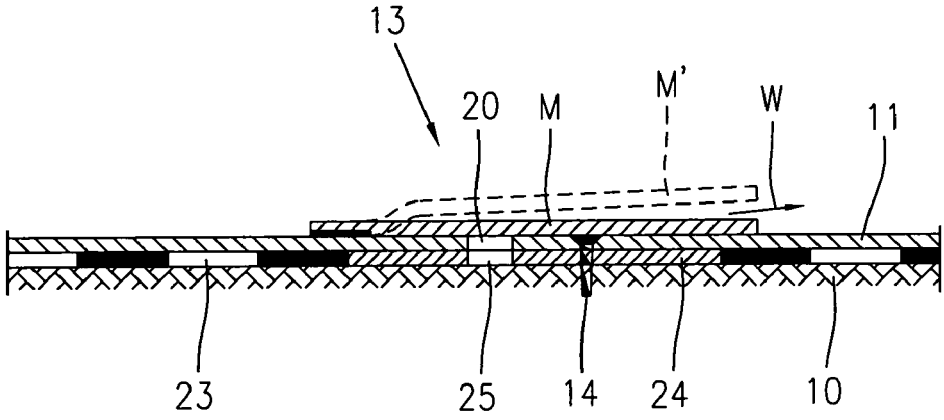
FIG. 7 is a cross-sectional view along the line 7-7 of FIG. 6 showing the valve device in two operative conditions.

FIGS. 6 and 7 show a second embodiment of a one-way valve device 13 of the membrane type, which can be achieved either at the time of installation of the waterproof sheathing, as in the previous case, or subsequentially with the waterproof sheathing already applied.

According to this embodiment, a cross-cut or elongated aperture 20 is made in one sheet 11 of the waterproof sheathing, in a direction transversal to the downflow direction of the seeped water, indicated by the arrow W.

A sheet M of elastically deformable synthetic or bituminous material defining a flat valving member is superimposed to the cut 20; the sheet M is sealingly connected, i.e. thermally sealed to the waterproof sheet 11, along three edges 21, leaving the fore edge 22 of the sheet M parallel to the cut 20, extending downstream with respect to the downflow direction W, to freely flex and rise under the thrust of the water which tends to flow downwards by gravity, as shown by the broken line indicated by reference M' in FIG. 7. In this way a one-way valve device 13 of geomembrane type is obtained, which can be applied to the waterproof sheathing of any hydraulic structure, dam, canal, hydraulic tunnel, reservoir or the like, for draining off the water that has seeped behind and in which the pressure of the water at upstream side or which flows in the hydraulic tunnel or in the canal, maintains the valve device 13 constantly closed by pressing the flat valving member M against the underlying sheet 11, allowing it to open exclusively when the pressure on the rear side of the flat valving member M exceeds that of the water on the front side.

Furthermore, when the dam, hydraulic tunnel or hydraulic structure is emptied, or when the pressure of the water that has seeped behind the waterproof sheathing tends to increase, exceeding the pressure of the water on the front side of the valve device 13, the differential pressure will open the valve 13 allowing the natural downflow of the seeped water. This prevents the accumulation of seeped water behind the waterproof sheathing from damaging or causing the latter to explode, due to an excessive deformation.

As mentioned previously, the waterproof sheathing provided by sheets 11 of flexible synthetic material, can be installed directly in contact with the surface of the hydraulic structure to be waterproofed; conversely, a drainage layer can be positioned between the facing surfaces of the hydraulic structure and the sheets 11 of the waterproof sheathing, consisting for example of a geonet, or in any case by a draining element as indicated by reference 23 in FIG. 7. In this case, it may be advantageous to dispose a rigid supporting element 24, for example made by a plate of stiff PVC, HDPE, metal or concrete, in correspondence with the valve device 13, making a cut or an aperture 25 in the element 24 in correspondence with the cut or aperture 20 in the waterproof sheet 11. The supporting element 24 must be able to comply with, smooth out or even eliminate the roughness of the surface to be protected, providing a smooth surface on which the waterproof sheathing or geomembrane may rest.

Figure 8:
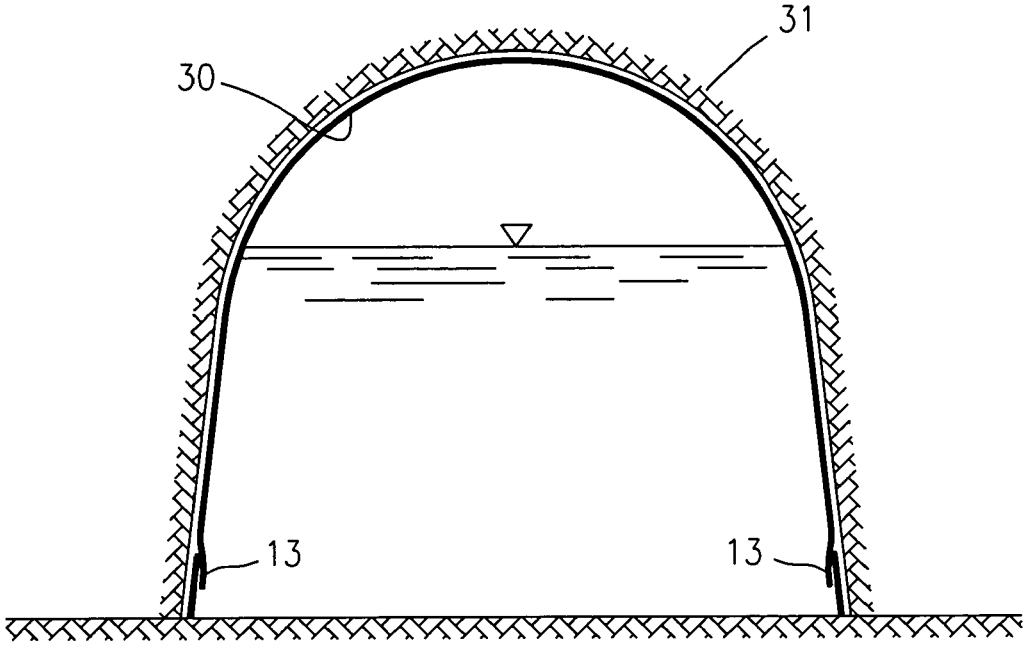
FIG. 8 shows a cross-sectional view of a hydraulic tunnel, provided with a waterproofing and drainage device according to the invention.
Figure 9:
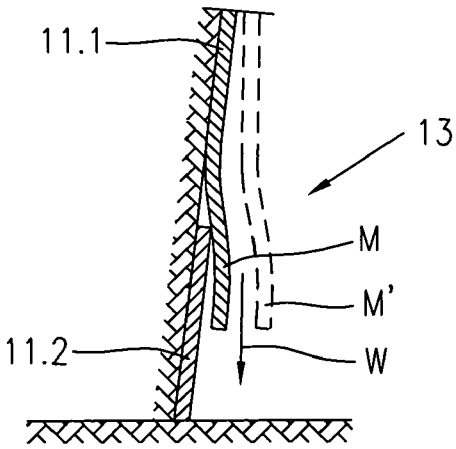
FIG. 9 shows an enlarged detail FIG. 8, with the valve device downwardly oriented.
Figure 10:
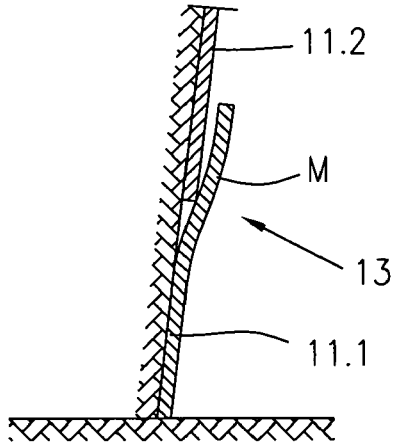
FIG. 10 shows a detail similar to that of the previous FIG., with the valve device upwardly oriented.

FIGS. 8, 9 and 10 show, also by way of example, the formation of valve devices 13 on the waterproof sheathing 30 of the body of a hydraulic tunnel 31.

Also in this case, the waterproof sheathing 30 comprises a plurality of sheets 11 of elastically deformable synthetic material, disposed in a transversal or longitudinal direction to the tunnel, always taking care to overlap the edges as shown in FIG. 1, which are sealed and secured by means of a plurality of anchoring pins, not shown, or in any other suitable way.

At the bottom, on the two opposite sides of the tunnel 31, or in pre-established positions of the waterproof sheathing 30, one-way drainage valve devices 13 are provided, in the way described previously, as schematically shown in the enlarged detail of FIG. 9, or 10, where the same numerical references as the preceding examples have been used to indicate similar or equivalent parts.

Figure 11:
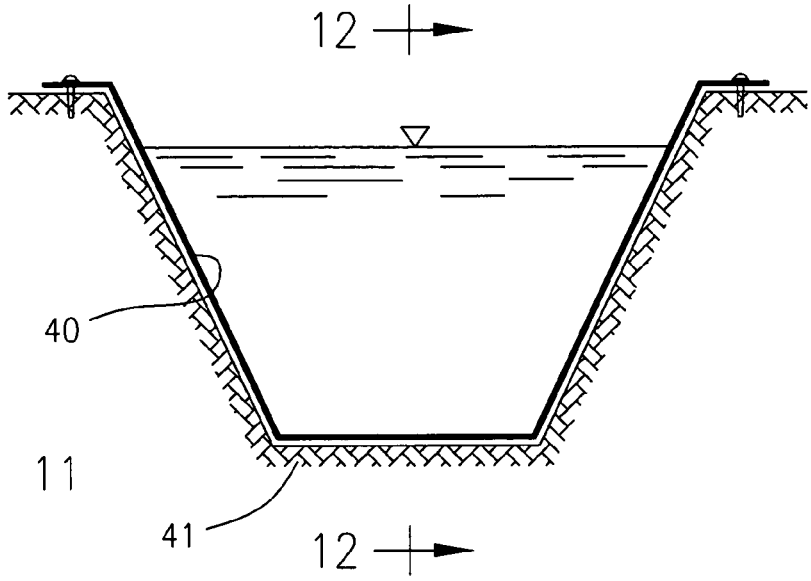
FIG. 11 shows a waterproof sheathing of an existing joint between two side walls of a hydraulic structure, comprising a drainage valve device according to the invention.
Figure 12:
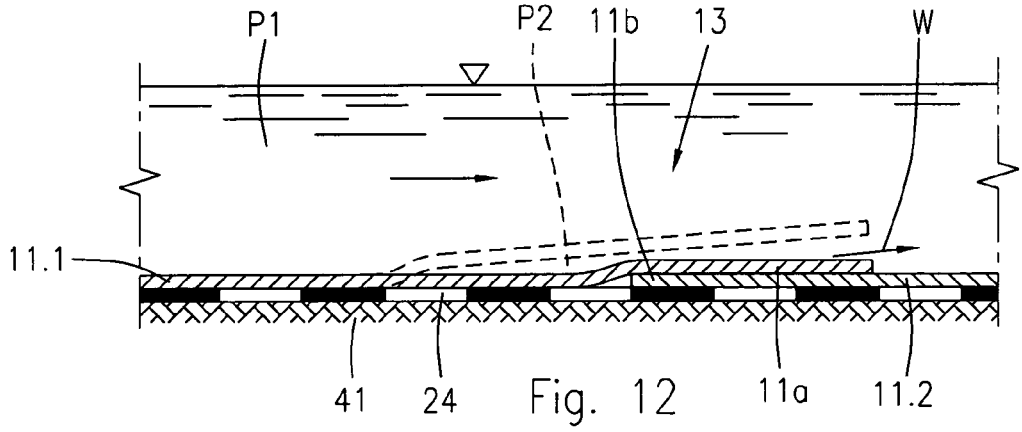
FIG. 12 shows a longitudinal sectional view along the line 12-12 of FIG. 11, with the drainage valve device both in a closed, and in an open condition.
Figure 13:
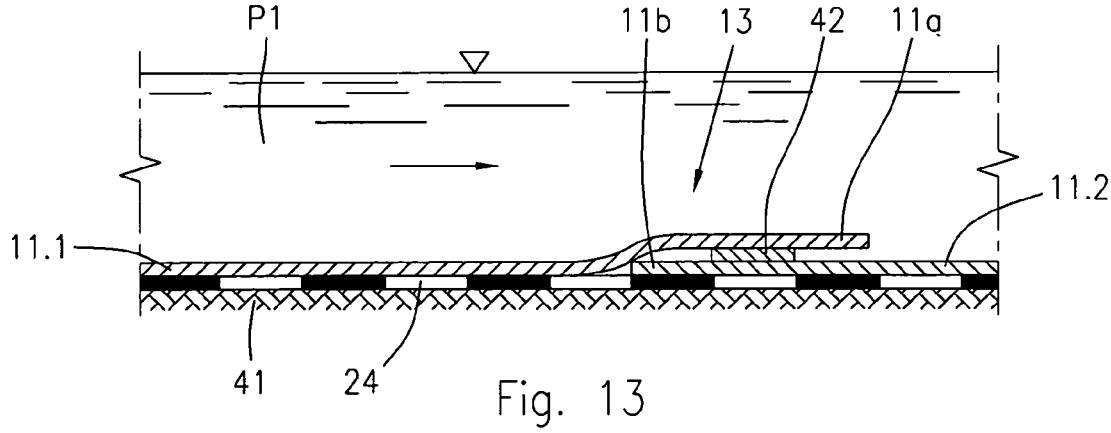
FIG. 13 shows a sectional view similar to that of the previous figure, designed to show the use of an additional sealing strip.
Figure 14:
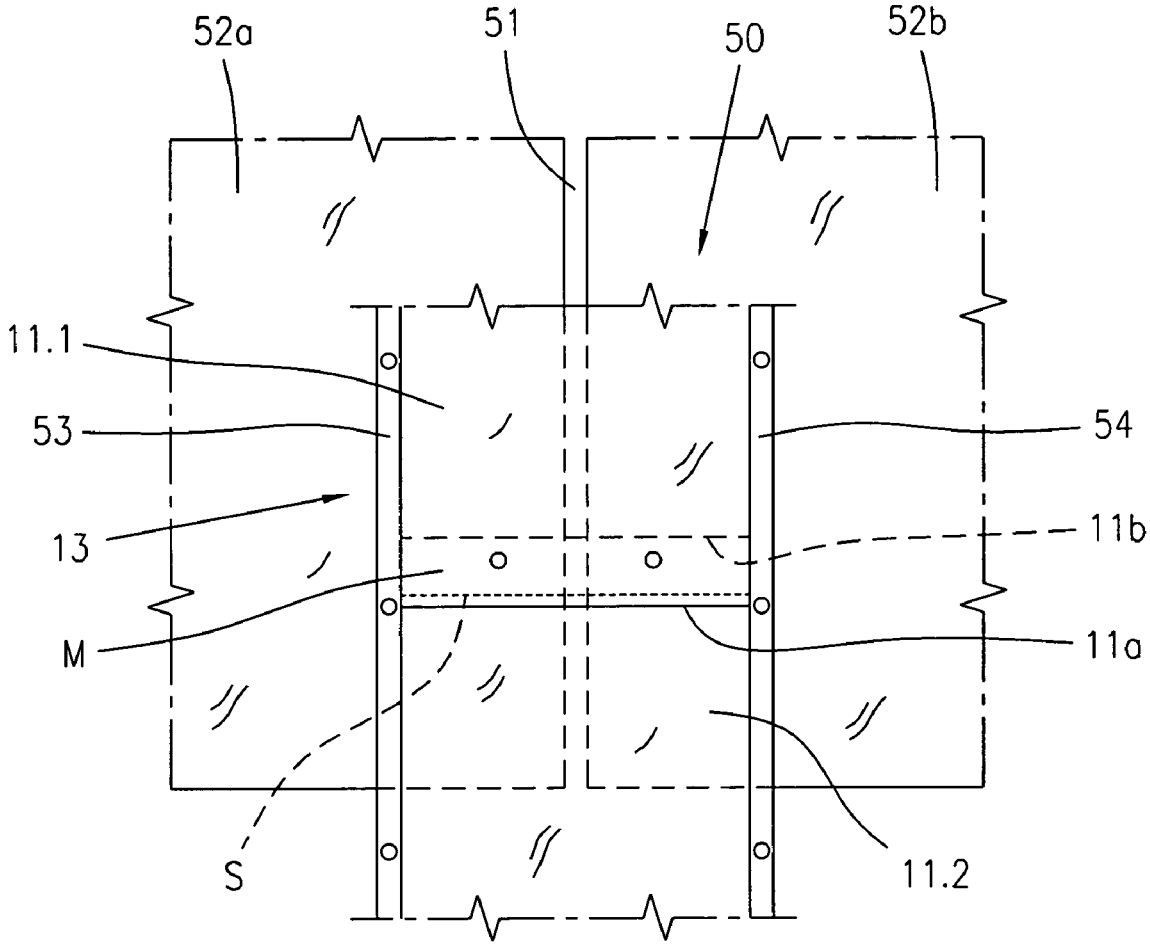
FIG. 14 shows a waterproof sheathing of an existing joint Between two side walls of a hydraulic structure, comprising a drainage valve device according to the invention.

Lastly, the example of FIG. 11 shows the application of a drainage valve device 13 according to the invention, in a waterproof sheathing 50 in correspondence with a joint 51, or a crack between the bodies of two wall parts 52*a* and 52*b* of a hydraulic structure.

Likewise, in FIG. 11 references 11.1 and 11.2 have been used to indicate two sheets of waterproof material, secured along the longitudinal edges 53, 54 on either side of the joint 51, for example as described in EP 1 157 168, or in any other way.

Also in this case, the opposite transversal edges 11*a* and 11*b* of the two sheets 11.1 and 11.2 are overlapped for a space of a pre-established length, leaving the edge 11*a* of the upper sheet 11.1 free to flex, to open and close the flat valving member M of the valve device 13 under the differential pressure of the water, in the way previously described; obviously, other modifications and/or applications of the waterproofing and drainage system by means of one-way valve devices are possible, compared to those shown.

For example, as show in FIGS. 3, 6 and 11 the drainage valve device 13 could initially be closed also on the fore side, in order to prevent infiltration of water during the filling of the hydraulic structure, or whenever the level of the water tends to rise. In this case, the closure on the free side of the valve device 13 can be obtained by means of a weak seal S, or adhesive tape, an additional strip of geomembrane or in any other suitable way to create a weakened breakage line when the pressure of the water on the rear side tends to exceed a certain value.

According to a further embodiment, the overlap "d" of the previous cases can be avoided by creating a simple cut along a line transversal to the moving or outflow direction of the water, as in FIG. 6, and subsequently covering such cut with a weaker geomembrane, of a more limited thickness than that of the underlying geomembrane, sealing it on all four sides. In this way the overlying weaker geomembrane sheet becomes a sort of "fuse" whose rupture would occur in the event of the hydraulic structure emptying out, or in the event of a decrease in the water level, with consequent exposure of the cut, thereby creating a drainage valve device 13. In this case it would be easy to restore the previous conditions by re-installing a new weak geomembrane sheet, positioning it over the cut.

From what has been described and shown in the accompanying drawings, it will be clear that what is provided is a method and a waterproofing and drainage device for draining off the seeped water in hydraulic structures, which makes use of a special drainage valve device, of the geomembrane type, oriented in the natural downflow direction of the water. The presence of a drainage device of this kind substantially reduces the loads supported by the anchorage points, thereby increasing the safety factor for the entire waterproof sheathing.

It is understood however that what has been described and shown should not be construed in a limitative sense with regard to any possible applications and ways of performing the one-way valve device, by the use of geomembrane sheets; therefore, other modifications or variations may be made both to the drainage device itself, and to the method without thereby departing from the scope of the claims.

The invention claimed is

1. A method for waterproofing and draining off seeped water in hydraulic structures (10, 31, 41, 52), in which a waterproof sheathing, consisting of elastically deformable geomembrane sheets (11), is applied and secured to a surface area of a wall of the body of the hydraulic structure (10, 31, 41, 52), providing said sheathing with a one-way water drainage valve (13) for draining off the seeped water collected behind the waterproof sheathing, comprising the steps of:

defining drainage points for draining off the water in pre-established positions of the waterproof sheathing;

providing, in each of the pre-established drainage point, a one-way drainage valve (13) having a water discharge aperture in said waterproof sheathing;

orienting said water discharging aperture of the drainage valve 13 in a natural downflow direction of the water and providing said drainage valve (13) with a flat flexible valving member (M), overlapping the discharging aperture;

subjecting the flat valving member (M) to a differential pressure of the water acting on opposite faces of the waterproof sheathing; and causing automatic opening and closing of the drainage valve (13), by the pressure difference of the water arising on the opposite faces of the flat valving member (M) of the drainage valve (13), characterised by the steps of:

providing said drainage valve (13) on a wall surface of the hydraulic structure (10, 31, 41, 52); and downwardly draining the seeped water by gravity.

2. The method for waterproofing and draining off seeped water according to claim 1, in which the waterproof sheathing comprises a plurality of waterproofing sheets (11) mechanically fastened to the hydraulic structure (10) sealed along the lateral edges, characterised by performing the drainage valve (13) during the installation of the waterproof sheathing, by superimposing transversal edges of two consecutive waterproofing sheets (11.1, 11.2), leaving the transversal edge of the upper sheet (11.1) to freely flex under the differential pressure of the water.

3. The method for waterproofing and draining off seeped water according to claim 2, characterised by superimposing the transversal edges of the two sheets (11.1, 11.2), over a length (d) ranging from 5 to 300 cm, preferably from 20 to 150 cm.

4. The method for waterproofing and draining off seeped water according to claim 1, characterised by providing the drainage valve (13) by performing a cut (20) in the waterproof sheet (11); positioning a flexible covering membrane (M) on said cut (20) and peripherally sealing said membrane (M) leaving a free fore edge (22) parallel to said cut (20) to define the flat valving member (M) of the drainage valve (13).

5. The method for waterproofing and draining off seeped water according to claim 4, characterised by providing a flat rigid support member beneath the sheathing, in correspondence of the covering membrane (M) of the drainage valve (13).

6. The method for waterproofing and draining off seeped water according to claim 1, characterised by performing a drainage valve (13) comprising a geomembrane sheet chosen from the following materials: thermoplastic materials, thermoplastic rubbers, thermoset materials, bituminous materials.

7. The method for waterproofing and draining off seeped water according to claim 6, characterised in that the drainage valve (13) comprising a geomembrane of a thermoplastic material chosen from: High density polyethylene, Linear low density polyethylene, Chlorinated polyethylene, Ethylene-vinyl acetate copolymer, Polyethylene, Polypropylene, Polyvinyl chloride, or combination thereof.

8. The method for waterproofing and draining off seeped water according to claim 6, characterised in that the drainage valve (13) comprises a geomembrane sheet (11) of a thermoplastic rubber-based material chosen from among the following: Chlorosulphonated polyethylene, Ethylene-propylene copolymer, or combination thereof.

9. The method for waterproofing and draining off seeped water according to claim 6, characterised in that the drainage valve (13) comprises a geomembrane sheet (11) of a thermoset synthetic material, chosen from: Polyisobutylene, Chloroprene rubber, Ethylene-propylene diene monomer, Butyl rubber, Nitrile rubber, or combination thereof.

10. The method for waterproofing and draining off seeped water as claimed in claim 6, characterised in that the drainage valve (13) consists of a geomembrane of bituminous material chosen from: Oxidised bitumen, Polymeric bitumen, or combination thereof.

11. The method for waterproofing and draining off seeped water according to claim 2, characterised by sealingly connecting the overlapped transversal edges of the waterproofing sheets (11) along a weakened breakage line (S).

12. The method for waterproofing and draining off seeped water according to claim 4, characterised by sealingly connecting the fore edge of the flat valving member (M), to the waterproof sheathing along a weakened breakage line (S).

13. The method for waterproofing and draining off seeped water according to claim 1, characterised by making a cut (20) in the waterproof sheathing; positioning and peripherally sealing a breakable closing geomembrane over said cut, said breakable closing geomembrane having a thickness lower than the waterproof sheathing sheets (11).

14. The method for waterproofing and for draining off seeped water according to claim 1, characterised by:

forming a waterproof sheathing by applying a plurality of waterproofing sheets (11) of a synthetic material, against a surface area of the hydraulic structure;

overlapping and sealingly fastening lateral edges of adjacent sheets (11), mechanically anchoring them to the body (10, 31, 41, 52) of the hydraulic structure; and providing a plurality of one-way drainage valves (13), in pre-established positions of the waterproof sheathing.

15. The method for waterproofing and draining off seeped water in a joint (51) between adjacent walls (52*a*, 52*b*) of a hydraulic structure, according to claim 1, characterised by comprising the steps of:

applying a plurality of waterproofing sheets (11.1; 11.2) of synthetic waterproofing material along said joint (51);

sealingly fastening the lateral edges of the water proofing sheets (11.1; 11.2) longitudinally to said joint (51); and providing at least one one-way drainage valve (13), by freely overlapping the adjacent transversal edges of two consecutive waterproofing sheets (11.1; 11.2).

16. The method for waterproofing and draining off seeped water, according to claim 1, characterised by positioning a layer of draining material between facing surfaces of the hydraulic structure (10, 31, 41, 52) and the waterproof sheathing (11).

17. The method for waterproofing and draining off seeped water, according to claim 16, characterised in that the layer of draining material is selected from a geonet, a geospacer, or combination thereof.

18. A device for waterproofing and draining off seeped water in hydraulic structures (10, 31, 41, 52), comprising:

a waterproof sheathing (11) provided by a geomembrane of elastically deformable material;

fastening means (14) to secure the geomembrane to a surface area of a wall of the hydraulic structure (10, 31, 41, 52), and drainage means for draining off the seeped water collected between the surface area of the hydraulic structure (10, 31, 41, 52) and the waterproof sheathing (11), said drainage means comprising:

a plurality of one-way drainage valves (13) on the waterproof geomembrane; each drainage valve comprising:

a water discharging aperture (20) in the waterproof geomembrane, said water discharging aperture (20) extending in a direction transversal to the natural downflowing direction of the seepage water; and a flexible flat valving member (M) sealingly fastened to the waterproofing membrane, said flat valving member (M) having a free edge which extends beyond said water discharging aperture (20), characterised in that the drainage valves (13) are provided on a wall of the body of the hydraulic structure (10, 31, 41, 52), said drainage valves (13) being arranged to drain the seepage water downwardly, by gravity.

19. The device for waterproofing and draining off seeped water according to claim 18, characterised in that the fore edge of the flat valving member (M) extends parallel to the water discharging aperture (20).

20. The device for waterproofing and draining off seeped water according to claim 19, characterised in that the fore edge of the flat valving member (M) extends beyond the water discharging aperture (20) for a length ranging from 5 to 300 cm, preferably from 20 to 150 cm.

21. The device for waterproofing and draining off seeped water according to claim 19, characterised in that the flat valving member (M) is in the form of flexible sheet material chosen selected from: Chlorinated polyethylene, Ethylene-vinyl acetate copolymer, Polyethylene, Polypropylene, Polyvinyl chloride, High density polyethylene, Linear low density polyethylene, Chlorosulphonate polyethylene, Ethylene-propylene copolymer, Polyisobutylene, Chloroprene rubber, Ethylene-propylene diene monomer, Butyl rubber, Nitrile rubber, Oxidised bitumen, Polymeric bitumen, taken singly or in combination.

22. The device for waterproofing and draining off seeped water according to claim 21, characterised in that the thickness of the sheet material is ranging from 0.2 to 20 mm.

* * * * *